US010660413B2

(12) United States Patent
Choi

(10) Patent No.: US 10,660,413 B2
(45) Date of Patent: May 26, 2020

(54) COMBINATION SETTING FOR JEWELRY STONES

(71) Applicant: F.D. Worldwide Merchandise Group, Inc., New York, NY (US)

(72) Inventor: Sheung S. Choi, Roslyn, NY (US)

( * ) Notice: Subject to any disclaimer, the term of this patent is extended or adjusted under 35 U.S.C. 154(b) by 100 days.

(21) Appl. No.: 15/467,901

(22) Filed: Mar. 23, 2017

(65) Prior Publication Data

US 2018/0271235 A1 Sep. 27, 2018

(51) Int. Cl.
*A44C 17/02* (2006.01)
*A44C 25/00* (2006.01)

(52) U.S. Cl.
CPC ..... *A44C 17/02* (2013.01); *A44C 25/001* (2013.01)

(58) Field of Classification Search
CPC ..... A44C 17/02; A44C 9/00
USPC ..... 63/15, 26, 27, 28; D11/91, 92
See application file for complete search history.

(56) References Cited

U.S. PATENT DOCUMENTS 7,444,835 B2 * 11/2008 Mehta ..... A44C 17/046 63/26
7,461,452 B1 * 12/2008 Kothari ..... A44C 17/046 29/10

* cited by examiner

*Primary Examiner* — Jack W Lavinder
(74) *Attorney, Agent, or Firm* — Stephen E. Feldman; Feldman Law Group, P.C.

(57) ABSTRACT

A jewelry setting including a structure having an outer circumference in a round shape and setting a first set of stones, a second set of stones and a third set of stones, the first set of stones being set within the structure using a combination of prongs and a first set of mounting apertures, the second set of stones being set within the structure using a combination of the prongs and a second set of mounting apertures, the third set of stones being set within the structure using a friction setting and a third set of mounting apertures, the first set of stones, the second set of stones and the third set of stones being arranged so that the first set of stones, the second set of stones and the third set of stones appear to be a continuous, uninterrupted surface thus creating an illusion of a large stone in the round shape.

7 Claims, 8 Drawing Sheets

COMBINATION SETTING FOR JEWELRY STONES

FIELD OF THE INVENTION

The present invention relates to brilliance enhancing jewelry devices and, more particularly, to a combination setting for jewelry stones adapted to help enhance brilliance, fire and scintillation of the jewelry stones.

BACKGROUND

The jewelry settings are normally provided with prongs that are widely used in the art to hold the diamonds within the settings. For example, U.S. Pat. No. D 315,698 shows a setting wherein the princess-cut diamond is held in place by the use of plurality of prongs. Moreover, the use of prong settings for setting multiple stones for creating an illusion of a big diamond is seen in prior art U.S. Pub. Nos. 2005/0144980 and 2007/0234758. However, the diamonds of these settings frequently come out as they undergo physical deterioration due to their outward configuration and orientation. In addition, the jewelry prongs are normally positioned over the upper surfaces of the diamonds and are especially adapted to at least partially enclose the upper surface of the diamonds that reduces the aesthetic effect of the diamonds as well.

The use of invisible mounting techniques to overcome the problems associated with the prong settings is well known in the art, wherein the diamonds are mounted on the settings without the use of the prongs. One such example of the mounting technique is channel setting. For example, U.S. Pub. No. 2008/0053148 shows one such setting that provides an invisible or mysterious setting system that has the particular feature of allowing several round precious stones of predefined shape to be assembled around a central round precious stone in such a way as entirely to eliminate grooves on the table side of the precious stones to result is an attractive appearance which gives the illusion of one large round precious stone when the stone is viewed from the table side. Moreover, U.S. Pat. No. 6,550,275 discloses a round gemstone setting with convexly configured gemstones that are set in flush, surface to surface mating relation. However, designing of the invisible settings using single shaped diamond can be a very difficult task especially for relatively larger and complex shaped diamonds, such as Marquise or Pear shaped diamonds. Such settings need substantial designing efforts from the designer/artisan with single shaped/cut diamonds and unnecessarily increase the effective cost of the jewelry article. Hence, the utilization of multi-shaped diamonds for forming marquise or pear shaped composite Diamond Head is needed.

There are few attempts seen in the art to use a plurality smaller diamonds to form a composite Diamond Head in order to reduce the effective cost and efforts being utilized. One such head can be seen in the prior art U.S. Pub. No, 2005/0188722 that discloses an exemplary system and method for providing a jewelry setting is disclosed that comprises a first gemstone in an array of gemstones generally retained at a girdle by fasteners that hold the a plurality of gemstones surrounding the first gemstone. Also, the prior art Pat. D 505,092 teaches an ornamental design for a diamond setting wherein the setting comprises total eleven diamonds that all are of round shape. However, the settings in the art have substantially failed to use multi-shaped diamonds/stones as the diamonds from the settings are generally of single shape. Hence, the utilization of multi-shaped diamonds such as, for example, smaller round, medium round, large round, princess and baguette stones to form a composite diamond head is needed.

SUMMARY OF THE INVENTION

In a first implementation, a jewelry setting can comprise: a structure having an outer circumference in a round shape and is capable of mounting a first set of stones, a second set of stones and a third set of stones. The first set of stones can be set within the structure using a combination of prongs and a first set of mounting apertures, the second set of stones can be set within the structure using the combination of the prongs and a second set of mounting apertures, while the third set of stones can be set within the structure using a friction setting and a third set of mounting apertures. The first set of stones, the second set of stones and the third set of stones are arranged on the structure so that the first set of stones, the second set of stones and the third set of stones appear to be a continuous, uninterrupted surface thus creating an illusion of a large stone in the round shape.

In some implementations, the first set of stones can include four round-cut stones, the second set of stones can include four round-cut stones and the third set of stones can include one or two round-cut stones. In some implementations, the first set of stones can be secured to the structure with a plurality of prongs in a north-east-south-west (NESW) orientation.

In some implementations, the second set of stones can be secured to the structure with a plurality of prongs and can be fitted between two adjacent stones of the first set of stones. In some implementations, the girdles of the second set of stones can be set slightly below the girdles of the first set of stones.

In some implementations, the third set of stones can be secured to the structure in the center of the north-east-south-west (NESW) orientation of the first set of stones with a friction setting. In some implementations, the girdle of the third set of stones can be slightly below girdles of the first set of stones.

In some implementations, the first set of stones can be larger than the second set of stones and the third set of stones and the second set of stones can be larger than the third set of stones.

In another implementation, a jewelry setting can comprise: a structure having an outer circumference in a rectangular shape and is capable of mounting a first set of stones, a second set of stones and a third set of stones. The first set of stones can be set within the structure using a combination of prongs and a first set of mounting apertures, the second set of stones can be set within the structure using a combination of the prongs and a second set of mounting apertures while the third set of stones can be set within the structure using a friction setting and a third set of mounting apertures. The first set of stones, the second set of stones and the third set of stones can be arranged so that the first set of stones, the second set of stones and the third set of stones appear to be a continuous, uninterrupted surface thus creating an illusion of a large stone in the rectangular shape.

In some implementations, the first set of stones can include four round-cut stones, the second set of stones can include four round-cut stones and the third set of stones can include one or two round-cut stones. In some implementations, the first set of stones can be secured to the structure with a plurality of prongs in a north-east-south-west (NESW) orientation. In some implementations, the second set of stones can be secured to the structure with a plurality of prongs and fit between two adjacent stones of the first set of stones. In some implementations, the girdles of the first set of stones can be set slightly below girdles of the second set of stones.

In some implementations, the third set of stones can be secured to the structure in the center of the second set of stones with a friction setting. In some implementations, the girdle of the third set of stones can be slightly below girdles of the second set of stones. In some implementations, the first set of stones are smaller than the second set of stones and the third set of stones and the third set of stones are larger than the second set of stones.

In another implementation, a jewelry setting can comprise: a structure having an outer circumference in an oval shape and capable of mounting a first set of stones, a second set of stones and a third set of stones. The first set of stones can be set within the structure using a combination of prongs and a first set of mounting apertures, the second set of stones can be set within the structure using a combination of the prongs and a second set of mounting apertures while the third set of stones can be set within the structure using a friction setting and a third set of mounting apertures. The first set of stones, the second set of stones and the third set of stones can be arranged so that the first set of stones, the second set of stones and the third set of stones appear to be a continuous, uninterrupted surface thus creating an illusion of a large stone in the oval shape.

In some implementations, the first set of stones can include four round-cut stones, the second set of stones can include four round-cut stones and the third set of stones can include one or two round-cut stones. In some implementations, the first set of stones can be secured to the structure with a plurality of prongs in a north-east-south-west (NESW) orientation. In some implementations, the second set of stones can be secured to the structure with a plurality of prongs and fit between two adjacent stones of the first set of stones. In some implementations, the girdles of the second set of stones can be set slightly below girdles of the first set of stones.

In some implementations, the third set of stones can be secured to the structure in the center of the north-east-south-west (NESW) orientation of the first set of stones with a friction setting. In some implementations, the girdle of the third set of stones can be slightly below girdles of the first set of stones. In some implementations, the first set of stones can be larger than the second set of stones and the third set of stones and the second set of stones can be larger than the third set of stones.

The advantages of the above jewelry settings are that the stones are set in such a way as to increase the fire, scintillation and brilliance of the stones by allowing light to enter each individual stone and be directed into and out of adjacent stones. Therefore, more light can be directed out of the stones as a cluster than they would individually. This enhancement in light also allows a viewer to see the stones as a single large stone as the increased brilliance impedes a viewer from seeing separation points between the stones.

For example, the brilliance of the gemstone, such as, a diamond, results from its very bright and smooth surface for reflection in combination with its high refractive index. Diamonds are cut in a manner such that when a viewer is looking at the crown/table, the light entering the diamond through the table/crown is reflected within the diamond by the pavilion's facets and exits through facets on the crown or the table for the benefit of the viewer. Fire describes the ability of die diamond to act as a prism and disperse white light into its colors. Fire is evaluated by the intensity and variety of color.

The disclosed technology allows light to be directed into a table of the smaller gemstones and since the crown is below the girdle of the larger gemstone any light that is reflected out of the crown of the smaller gemstones will pass through the larger gemstone. This increases the fire, scintillation and brilliance of the larger gemstones.

Furthermore, the placement of the prongs further directs light to the viewer enhancing this larger stone appearance. This combination also allows the cluster of stones to appear as a continuous, uninterrupted surface thereby creating an illusion of a large karat stone with high-quality fire, scintillation and brilliance.

BRIEF DESCRIPTION OF DRAWINGS

The above mentioned and other features, aspects and advantages of the present invention will become better understood with regard to following description, appended claims and accompanying drawings, wherein like reference numerals refer to similar parts throughout the several views where:

DETAILED DESCRIPTION

Figure 1:
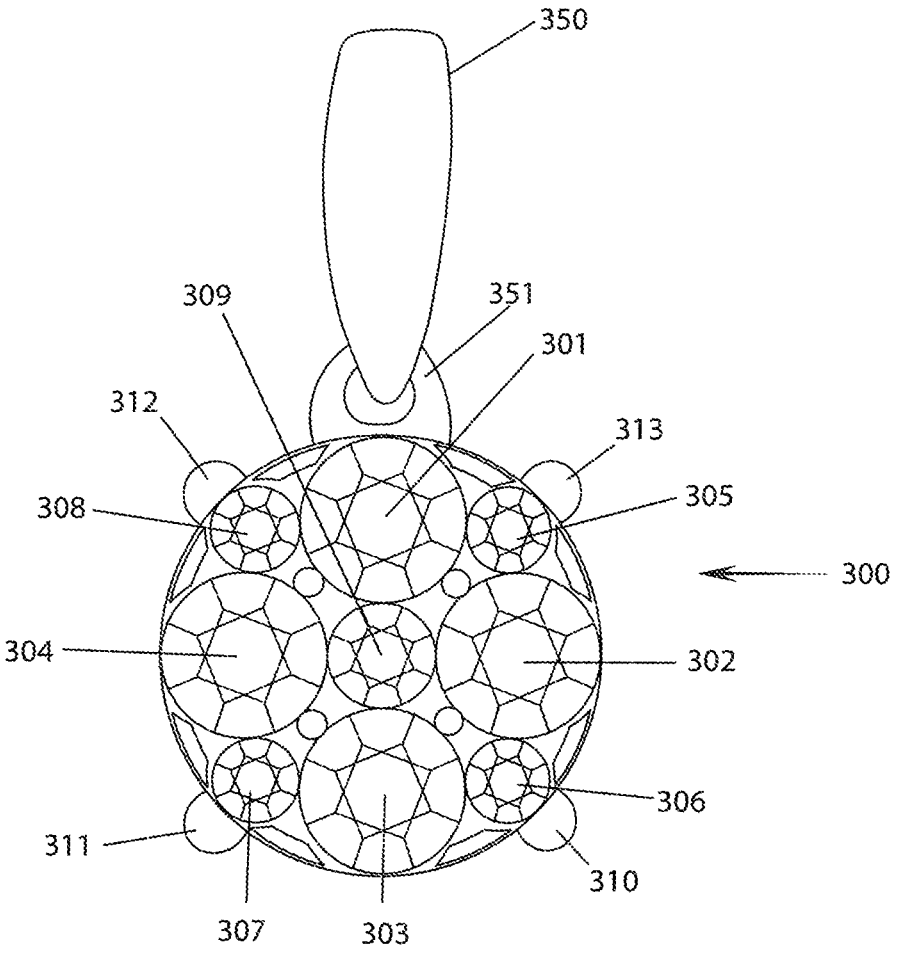
FIG. 1 is a top view of a pendant with a combination prong, and friction setting.

Although specific terms are used in the following description for sake of clarity, these terms are intended to refer only to particular structure of the invention selected for illustration in the drawings, and are not intended to define or limit the scope of the invention.

The brilliance of the gemstone, such as, a diamond, results from its very bright and smooth surface for reflection in combination with its high refractive index. Diamonds are cut in a manner such that when a viewer is looking at the crown/table, the light entering the diamond through the table/crown is reflected within the diamond by the pavilion's facets and exits through facets on the crown or the table for the benefit of the viewer. Fire describes the ability of the diamond to act as a prism and disperse white light into its colors. Fire is evaluated by the intensity and variety of color.

The disclosed technology allows light to be directed into a plurality of adjacent gemstones where some of the crowns of the gemstones are positioned below the girdle of other gemstones. This allows any light that is reflected out of the crown of the lower gemstones to be directed into and pass through upper gemstones thereby increasing the fire, scintillation and brilliance of the upper gemstones. The increase the fire, scintillation and brilliance also allows the plurality of adjacent gemstones to appear as a single large stone.

Figure 2A:
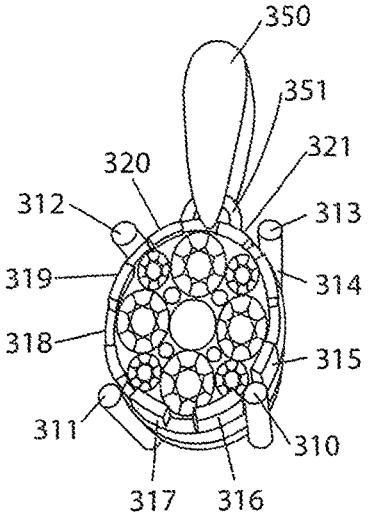
FIGS. 2*a-f* are different view of the pendent of FIG. 1.
Figure 2B:
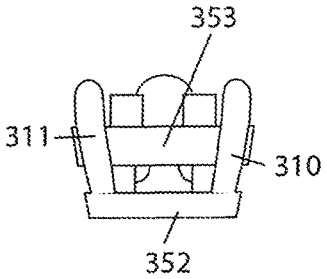
Figure 2C:
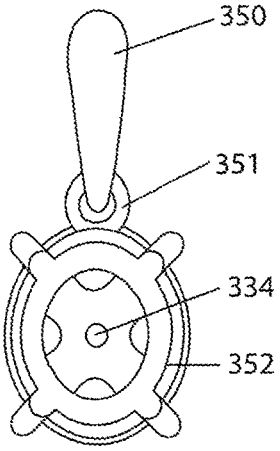
Figure 2D:
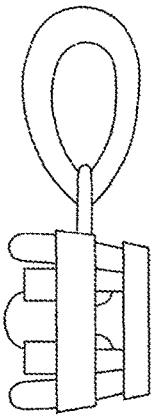
Figure 2E:
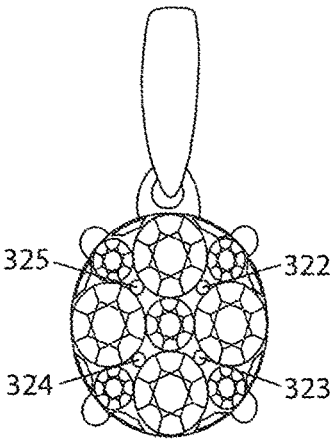
Figure 2F:
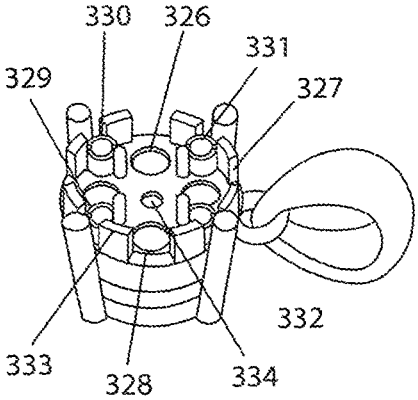

FIGS. 1 and 2*a-f* show a jewelry setting 300 for a pendant. The jewelry setting 300 is a combination of stones 301-309, prongs 310-325 and mounting apertures 326-334 arranged on a round structure so that the combination of stones

301-109 can appear as a large single stone. In one example, the combination of stones 301-309 can include three sizes of round cut stones, e.g. small, medium and large. Each stone 301-309 can be aligned with a mounting aperture 326-334 on the structure for placement. Once in place, the combination of stones 301-309 can be secured in place on the round structure 352. That is, the large stones 301-304 can be secured to the structure using prongs 310-325. The medium stones 305-308 can be arranged in between adjacent large stones and share prongs 310-325 with the large stones. In some implementations, the mounting apertures can be raised on a platform so that the girdle of the medium stones is slightly below or equal to the height of the girdles of the large stones.

A small stone 309 can be set in the center of the round structure 353. The small stone 309 can be set using a friction setting. That is, the small stone 309 can be placed in the center of four large stones 301-304 and be set slightly below the girdles of the large stones 301-304. This allows the small stone 309 to be tightly placed within the center of the large stones 301-304 without the need for prongs or any other type of securement mechanism. The structure can also include loop 351 for securing a clasp 350 to the pendent 300.

For example, a jewelry setting can include a structure having an outer circumference in a round shape and set a first set of stones, a second set of stones and a third set of stones. The first set of stones can be set within the structure using a combination of prongs and mounting apertures, the second set of stones can be set within the structure using a combination of the prongs and a second set of mounting apertures and a center stone can be within the structure using a friction setting and a mounting aperture. The first set of stones can be secured to the structure with a plurality of prongs in a north-east-south-west (NESW) orientation. The second set of stones can secured to the structure with a plurality of prongs and fit between two adjacent stones of the first set of stones with the girdles of the second set of stones being set slightly below girdles of the first set of stones. The center stone can be secured to the structure in the center of the north-east-south-west (NESW) orientation of the first set of stones with the friction setting. A girdle of the center stone can be set slightly below the girdles of the first set of stones. In some implementations, the first set of stones can be larger than the second set of stones and the third set of stones and the second set of stones can larger than the third set of stones.

Figure 3:
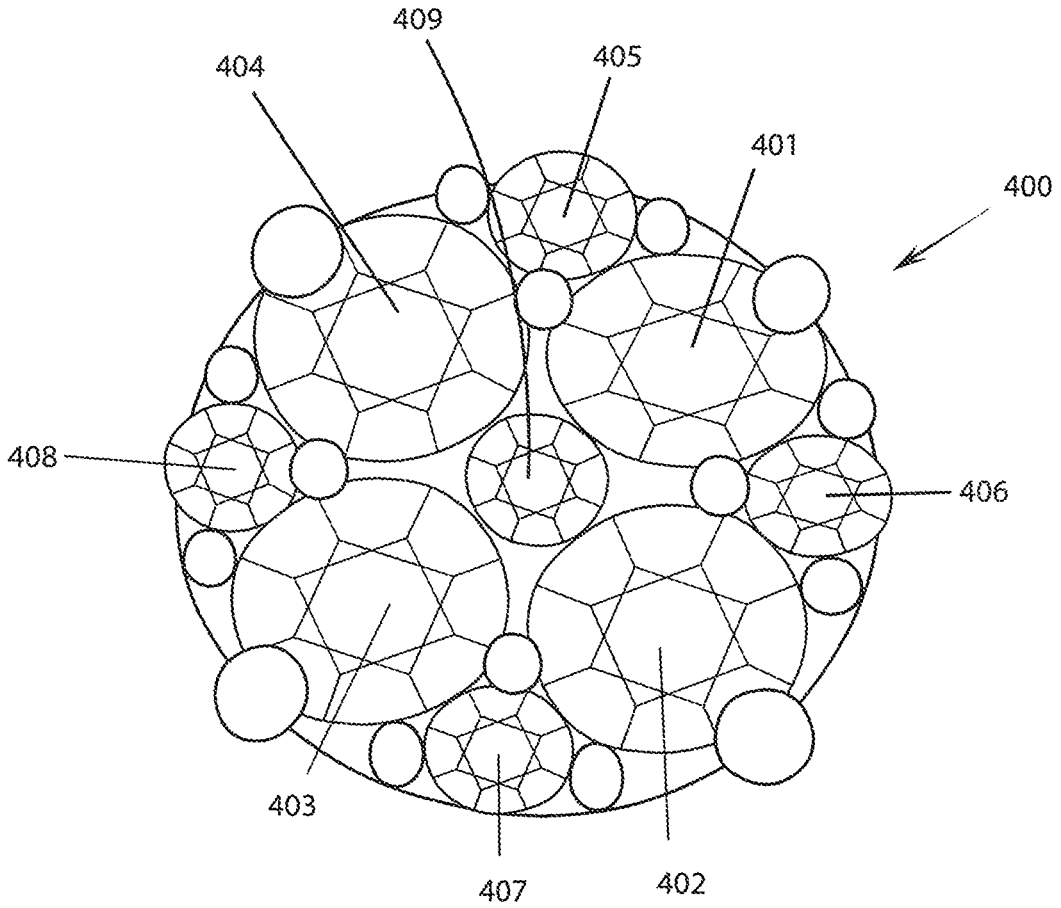
FIG. 3 is a top view of a ring head with a combination prong and friction setting.
Figure 4A:
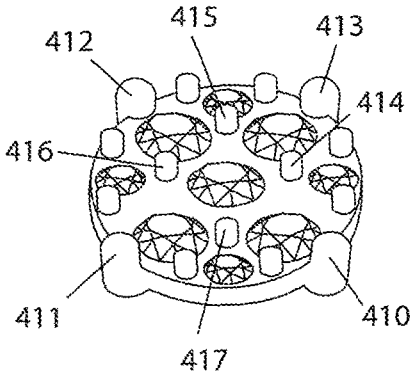
FIGS. 4*a-f* are different view of the ring head of FIG. 3.
Figure 4B:
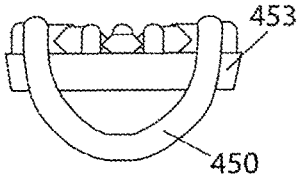
Figure 4C:
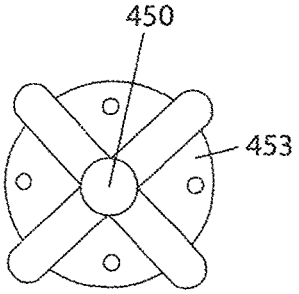
Figure 4D:
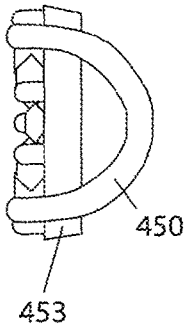
Figure 4E:
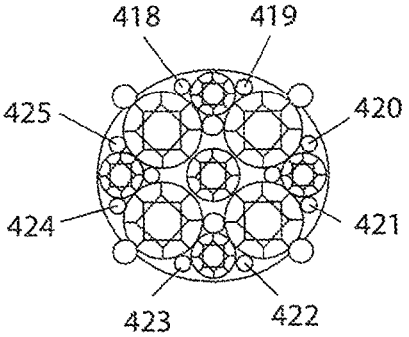
Figure 4F:
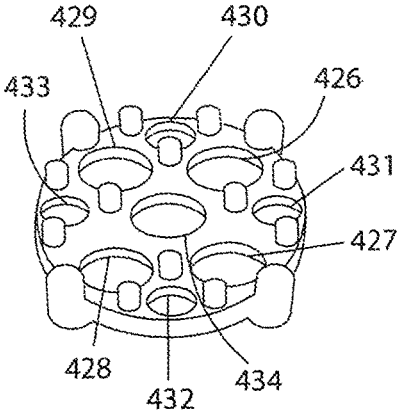

FIGS. 1 and 2*a-f* are an example of a pendent but other jewelry items are considered. For example, a ring head 400 is shown in FIGS. 3 and 4*a-f*. The jewelry setting 400 can be a combination of stones 401-409, prongs 410-425 and mounting apertures 426-434 arranged on a round structure 453. The combination of stones 401-409 can include three sizes of round-cut stones, e.g. small, medium and large. Each stone 401-409 has a mounting aperture 426-434 for placement. The combination of stones 401-409 can be set in a round structure 452. The large stones 401-404 are secured to the structure using prongs 410-425. The medium stones 405-408 can be arranged to be in between adjacent large stones and share the prongs 410-425 with the large stones. The small stone 409 can be set in the center of the structure 453. The small stone 409 is set using a friction setting. That is, the small stone 409 is placed in the center of four large stones 401-404 and is set slightly below the girdles of the large stones 401-404. This allows the small stone 409 to be tightly placed within the center of the large stones 401-404 without the need for a securing mount. The ring head 400 also includes a mounting structure 450 for securing the ring head 400 to a ring body (not shown).

Figure 5:
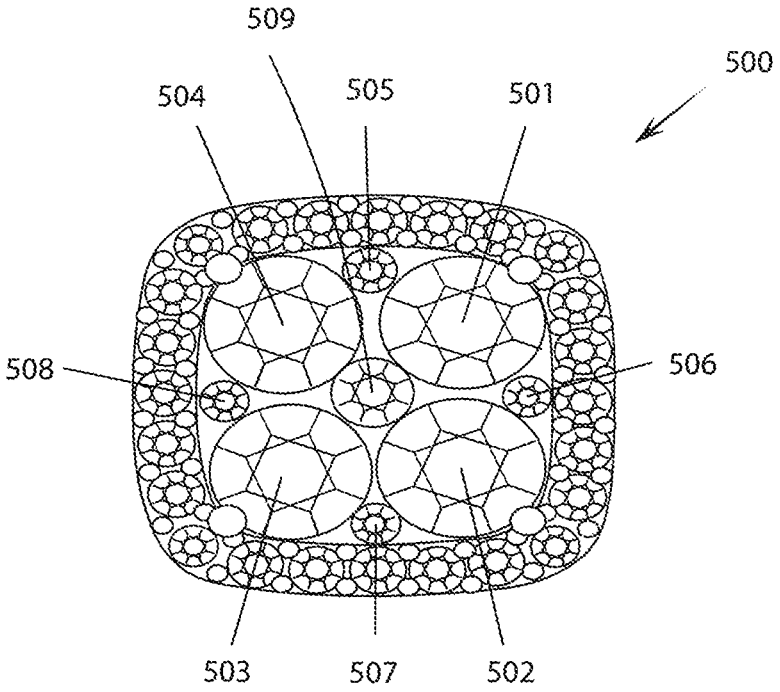
FIG. 5 is a top view of an earring with a combination prong and friction setting.
Figure 6A:
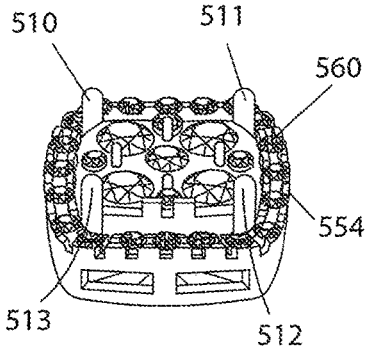
FIGS. 6*a-f* are different view of the earring of FIG. 5.
Figure 6B:
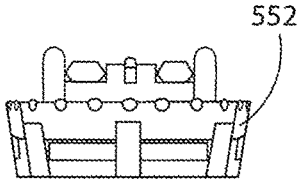
Figure 6C:
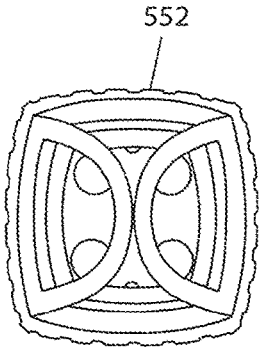
Figure 6D:
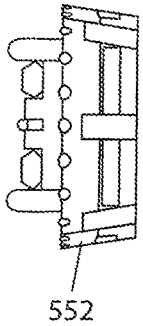
Figure 6E:
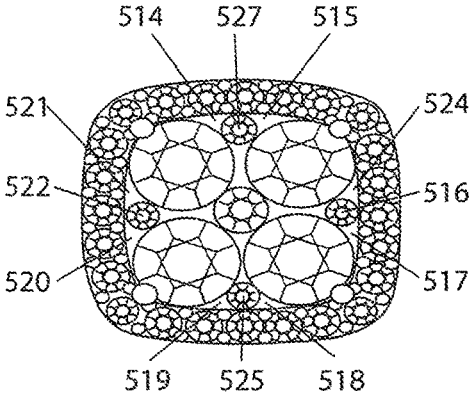
Figure 6F:
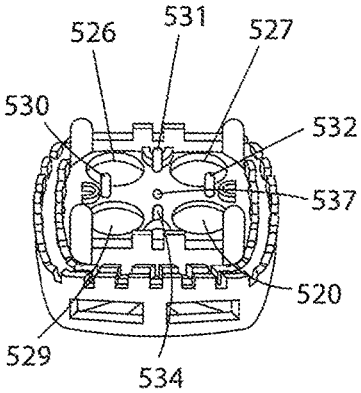

FIGS. 5 and 6*a-f* show a jewelry setting for a single caning 500 of a pair of earring. The jewelry setting 500 is a combination of stones 501-509, prongs 510-525 and mounting apertures 526-534 arranged in a rectangular structure so as to appear as a large stone. The combination of stones 501-509 can include three sizes of round-cut stones, e.g. small, medium and large. Each stone 501-509 has a mounting aperture 526-534 for placement. The combination of stones 501-509 can be set in a rectangular structure 552. The large stones 501-504 are secured to the structure using prongs 510-525. The medium stones 505-508 can be arranged to be in between adjacent large stones and share the prongs 510-525 with the large stones. The small stone 509 can be set in the center of the structure 553. The small stone 509 is set using a friction setting. That is, the small stone 509 is placed in the center of four large stones 501-504 and is set slightly below the girdles of the large stones 501-504. This allows the small stone 509 to be tightly placed within the center of the large stones 501-504 without the need for a securing mount. The earring setting 500 also includes a periphery of stones 560 on an outer platform 554.

For example, a jewelry setting can include a structure having an outer circumference in a rectangular shape and set a first set of stones, a second set of stones and a third set of stones. The first set of stones being set within the structure using a combination of prongs and a first set of mounting apertures, the second set of stones being set within the structure using a combination of the prongs and a second set, of mounting apertures, the third set of stones being set within the structure using a friction setting and a third set of mounting apertures, the first set of stones, the second set of stones and the third set of stones being arranged so that the first set of stones, the second set of stones and the third set of stones appear to be a continuous, uninterrupted surface thus creating an illusion of a large stone in the rectangular shape. The first set of stones can be secured to the structure with a plurality of prongs in a north-east-south-west (NESW) orientation. In some implementations, the second set of stones are secured to the structure with a plurality of prongs and fit between two adjacent stones of the first set of stones with the girdles of the first set of stones being set slightly below girdles of the second set of stones. The third set of stones are secured to the structure in the center of the second set of stones with the friction setting with a girdle of the third set of stones is slightly below girdles of the second set of stones. In some implementations, the first set of stones are smaller than the second set of stones and the third set of stones and the third set of stones are larger than the second set of stones.

Figure 7:
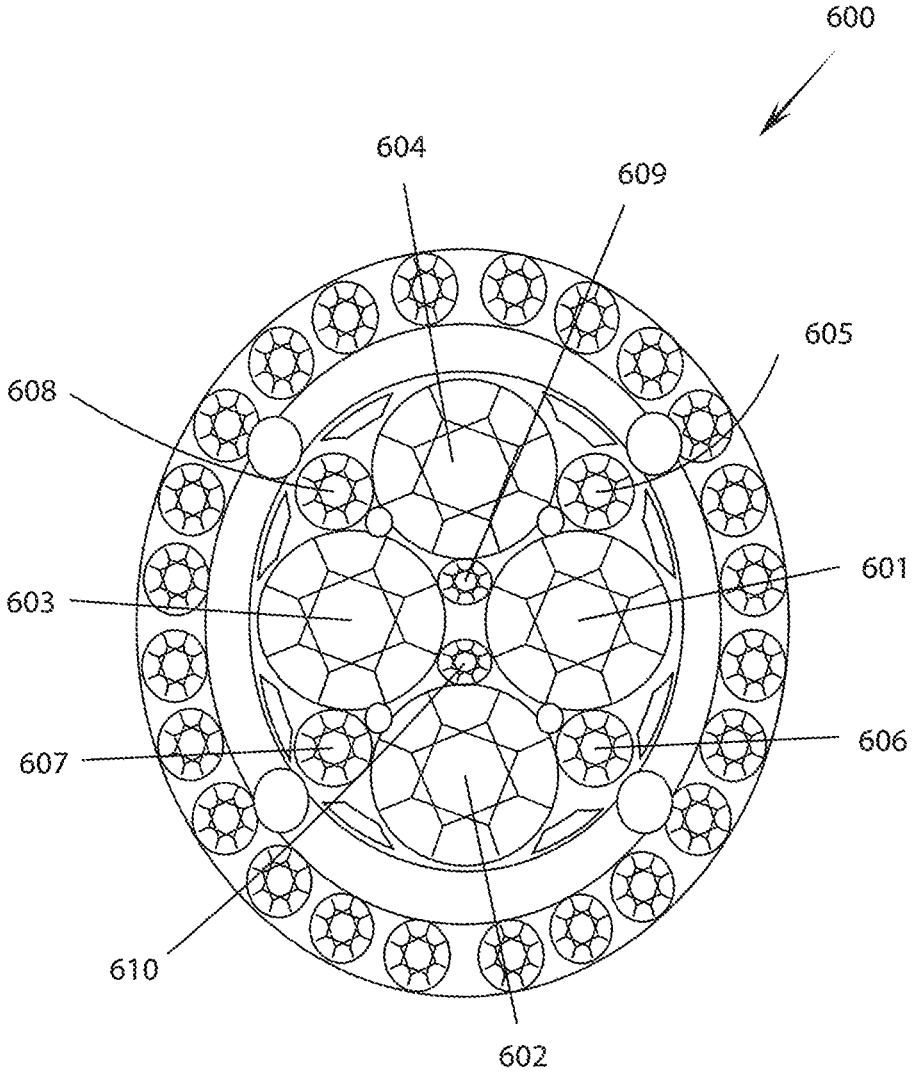
FIG. 7 is a top view of an earring with a combination prong and friction setting.
Figure 8A:
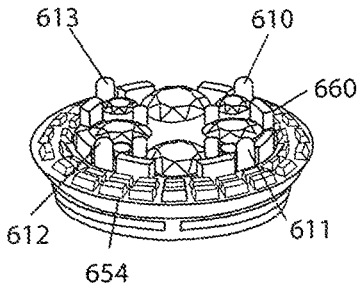
FIGS. 8*a-f* are different view of the earring of FIG. 7
Figure 8B:
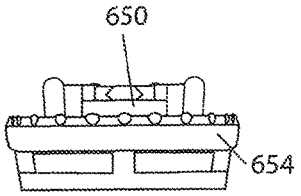
Figure 8C:
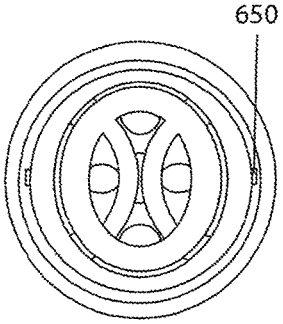
Figure 8D:
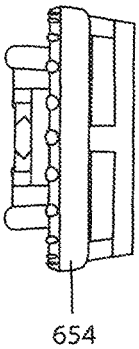
Figure 8E:
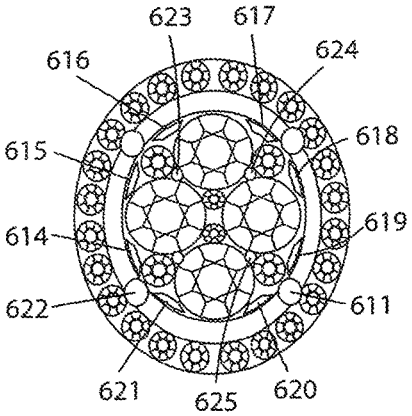
Figure 8F:
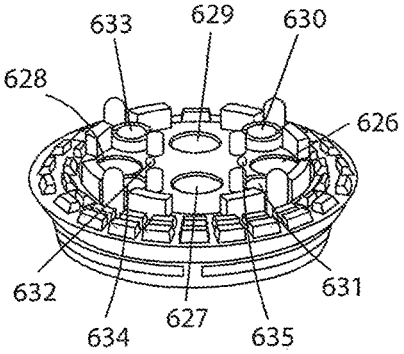

FIGS. 7 and 8*a-f* shows a jewelry setting for an earring 600 of a pair of earrings. The jewelry setting 600 is a combination of stones 601-609 prongs 610-625 and mounting apertures 626-634 arranged in an oval structure so as to appear as a large stone. The combination of stones 601-609 can include three sizes of round-cut stones, e.g. small, medium and large. Each stone 601-609 has a mounting aperture 626-635 for placement. The combination of stones 601-609 can be set in an oval structure 652. The large stones 601-604 are secured to the structure using prongs 610-625. The medium stones 605-608 can be arranged to be in between adjacent large stones and share the prongs 610-625 with the large stones. The small stone 609 can be set in the center of the structure 653. The small stone 609 is set using a friction setting. That is, the small stone 609 is placed in the center of four large stones 601-604 and is set slightly below the girdles of the large stones 601-604. This allows the small stone 609 to be tightly placed within the center of the large stones 601-604 without the need for a securing mount. The earring setting 600 also includes a periphery of stones 660 on an outer platform 654.

In another example, a jewelry setting can include a structure having an outer circumference in an oval shape and set a first set of stones, a second set of stones and a third set of stones. The first set of stones can be set within the structure using a combination of prongs and a first set of mounting apertures, the second set of stones being set within the structure using a combination of the prongs and a second set of mounting apertures, the third set of stones being set within the structure using a friction setting and a third set of mounting apertures. The first set of stones, the second set of stones and the third set of stones can be arranged so that the first set of stones, the second set of stones and the third set of stones appear to be a continuous, uninterrupted surface thus creating an illusion of a large stone in the oval shape.

The first set of stones can be secured to the structure with a plurality of prongs in a north-east-south-west (NESW) orientation. The second set of stones can be secured to the structure with a plurality of prongs and fit between two adjacent stones of the first set of stones with the girdles of the second set of stones are set slightly below girdles of the first set of stones. The third set of stones can be secured to the structure in the center of the north-east-south-west (NESW) orientation of the first set of stones with the friction setting and a girdle of the third set of stones is slightly below girdles of the first set of stones. The first set of stones can be larger than the second set of stones and the third set of stones and the second set of stones can be larger than the third set of stones.

In the above implementations, the stones are set in such a way as to increase the fire, scintillation and brilliance of the stones by allowing light to enter each individual stone and be directed into and out of adjacent stones. Therefore, more light can be directed out of the stones as a cluster than they would individually. This enhancement in light also allows a viewer to see the stones as a single large stone as the light impedes separation points between the stones. Furthermore, the placement of the prongs further directs light to the viewer enhancing this larger stone appearance. This combination also allows the cluster of stones to appear as a continuous, uninterrupted surface thereby creating an illusion of a large karat stone with high-quality brilliance and clarity.

The foregoing Detailed Description is to be understood as being in every respect illustrative, but not restrictive, and the scope of the disclosed technology disclosed herein is not to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

The invention claimed is:

1. A jewelry setting comprising: a structure having an outer circumference in a round shape and setting a first set of stones, a second set of stones and a third set of stones, the first set of stones being set within the structure using a combination of prongs and a first set of mounting apertures, the second set of stones being set within the structure using a combination of the prongs and a second set of mounting apertures, the third set of stones being set within the structure using a friction setting and a third set of mounting apertures, the friction setting securing the third set of stones in such a way that the third set of stones are set below girdles of the first set of stones without a securing mount engaging the third set of stones, the first set of stones, the second set of stones and the third set of stones being arranged so that the first set of stones, the second set of stones and the third set of stones appear to be a continuous, uninterrupted surface thus creating an illusion of a large stone in the round shape.

2. The jewelry setting of claim 1 wherein the first set of stones includes four round-cut stones, the second set of stones includes four round-cut stones and the third set of stones includes one round-cut stone.

3. The jewelry setting of claim 1 wherein the first set of stones are secured to the structure with a plurality of prongs in a north-east-south-west (NESW) orientation.

4. The jewelry setting of claim 3 wherein the second set of stones are secured to the structure with a plurality of prongs and fit between two adjacent stones of the first set of stones.

5. The jewelry setting of claim 4 wherein girdles of the second set of stones are set slightly below girdles of the first set of stones.

6. The jewelry setting of claim 3 wherein the third set of stones are secured to the structure in the center of the north-east-south-west (NESW) orientation of the first set of stones with the friction setting.

7. The jewelry setting of claim 1 wherein the first set of stones are larger than the second set of stones and the third set of stones and the second set of stones are larger than the third set of stones.

* * * * *